US009821974B2

(12) United States Patent
Takahashi

(10) Patent No.: US 9,821,974 B2
(45) Date of Patent: Nov. 21, 2017

(54) SHEET CONVEYING APPARATUS

(71) Applicant: BROTHER KOGYO KABUSHIKI KAISHA, Nagoya-shi, Aichi-ken (JP)

(72) Inventor: Eisuke Takahashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 34 days.

(21) Appl. No.: 14/671,196

(22) Filed: Mar. 27, 2015

(65) Prior Publication Data

US 2015/0274465 A1 Oct. 1, 2015

(30) Foreign Application Priority Data

Mar. 31, 2014 (JP) ..... 2014-072518

(51) Int. Cl.
*B65H 7/02* (2006.01)
*B65H 7/12* (2006.01)
*B65H 5/06* (2006.01)

(52) U.S. Cl.
CPC ..... *B65H 7/12* (2013.01); *B65H 5/062* (2013.01); *B65H 2511/524* (2013.01);
(Continued)

(58) Field of Classification Search
CPC .. B65H 7/06; B65H 2407/30; B65H 2511/16; B65H 2511/50; B65H 2513/512;
(Continued)

(56) References Cited

U.S. PATENT DOCUMENTS 5,335,043 A * 8/1994 Kluger ..... B65H 7/04 271/258.01
8,936,343 B2 1/2015 Hazeyama et al.
(Continued)

FOREIGN PATENT DOCUMENTS

JP H05-238599 A 9/1993
JP H10-316275 A 12/1998
(Continued)

OTHER PUBLICATIONS

Japanese Office Action issued in counterpart Japanese Patent Application No. 2014-072518, dated Jan. 24, 2017.

*Primary Examiner* — Thomas Morrison
(74) *Attorney, Agent, or Firm* — Merchant & Gould P.C.

(57) ABSTRACT

A conveying mechanism has a pair of nipping members configured to nip a sheet from both sides thereof at a nipping position and to convey the sheet from upstream to downstream side. The pair of nipping members includes a conveying roller. A controller performs: a motor controlling process of controlling the motor to perform a conveying operation of the sheet by rotation of the conveying roller; a reaction-force calculating process of calculating a reaction-force inference value which corresponds to reaction force that acts on the motor, by removing a friction component generated due to rotation of the motor from a disturbance inference value, the disturbance inference value being calculated from both a control input to the motor and a control output relative to the control input; and a warning process of outputting warning in response to occurrence of multiple feeding of the sheet, based on the reaction-force inference value.

11 Claims, 7 Drawing Sheets

(52) U.S. Cl.
CPC ..... *B65H 2513/10* (2013.01); *B65H 2515/32* (2013.01); *B65H 2515/704* (2013.01); *B65H 2557/24* (2013.01); *B65H 2801/39* (2013.01)

(58) Field of Classification Search
CPC ... B65H 5/00; B65H 7/00; B65H 7/02; B65H 7/20; B65H 2553/00; B65H 2553/20; B65H 2553/51; B65H 2557/20; B65H 2511/524; B65H 7/12; B65H 7/125
USPC ..... 271/258.01, 265.01, 258.04
See application file for complete search history.

(56) References Cited

U.S. PATENT DOCUMENTS

| | | | | |
|---|---|---|---|---|
| 2004/0070142 | A1 | 4/2004 | Kawasaki | |
| 2015/0091238 | A1* | 4/2015 | Hatakeyama ..... | B65H 7/06 271/3.16 |

FOREIGN PATENT DOCUMENTS

| | | | |
|---|---|---|---|
| JP | 2003-285484 | A | 10/2003 |
| JP | B 4143602 | B2 | 9/2008 |
| JP | 2009-249075 | A | 10/2009 |
| JP | 2012-253414 | A | 12/2012 |
| JP | 2014-048929 | A | 3/2014 |
| WO | 03101871 | A1 | 12/2003 |

* cited by examiner

SHEET CONVEYING APPARATUS

CROSS REFERENCE TO RELATED APPLICATIONS

This application claims priority from Japanese Patent Application No. 2014-072518 filed Mar. 31, 2014. The entire content of the priority application is incorporated herein by reference.

TECHNICAL FIELD

The invention relates to a sheet conveying apparatus.

BACKGROUND

Conventionally, a sheet conveying apparatus is known that detects multiple feeding of paper and paper jam. For example, a sheet conveying apparatus detects multiple feeding of paper based on thickness of paper.

SUMMARY

According to one aspect, this specification discloses a sheet conveying apparatus. The sheet conveying apparatus includes a motor, a conveying mechanism, and a controller. The conveying mechanism has a pair of nipping members configured to nip a sheet from both sides thereof at a nipping position and to convey the sheet from an upstream side to a downstream side. The pair of nipping members includes a conveying roller configured to be rotated by the motor. The controller is configured to perform: a motor controlling process of controlling the motor to perform a conveying operation of the sheet by rotation of the conveying roller; a reaction-force calculating process of calculating a reaction-force inference value which corresponds to reaction force that acts on the motor, by removing a friction component generated due to rotation of the motor from a disturbance inference value, the disturbance inference value being calculated from both a control input to the motor and a control output relative to the control input; and a warning process of outputting warning in response to occurrence of multiple feeding of the sheet, based on the reaction-force inference value.

BRIEF DESCRIPTION OF THE DRAWINGS

Embodiments in accordance with the invention will be described in detail with reference to the following figures wherein.

DETAILED DESCRIPTION

Hereinafter, referring to the accompanying drawings, an illustrative embodiment according to aspects of the disclosures will be provided. It should be noted that the illustrative embodiment described hereinafter is merely an example and modification may be realized without departing from the aspects of the disclosures.

It is noted that various connections are set forth between elements in the following description. It is noted that these connections in general and unless specified otherwise, may be direct or indirect and that this specification is not intended to be limiting in this respect. Aspects of the present disclosures may be implemented on circuits (such as Application Specific Integrated Circuits) or in computer software as programs storable on computer-readable media including but not limited to RAMs, ROMs, flash memories, NVROMs, CD-media, DVD-media, BD-media, temporary storages, hard disk drives, permanent storages, and the like.

First Embodiment

Figure 1:
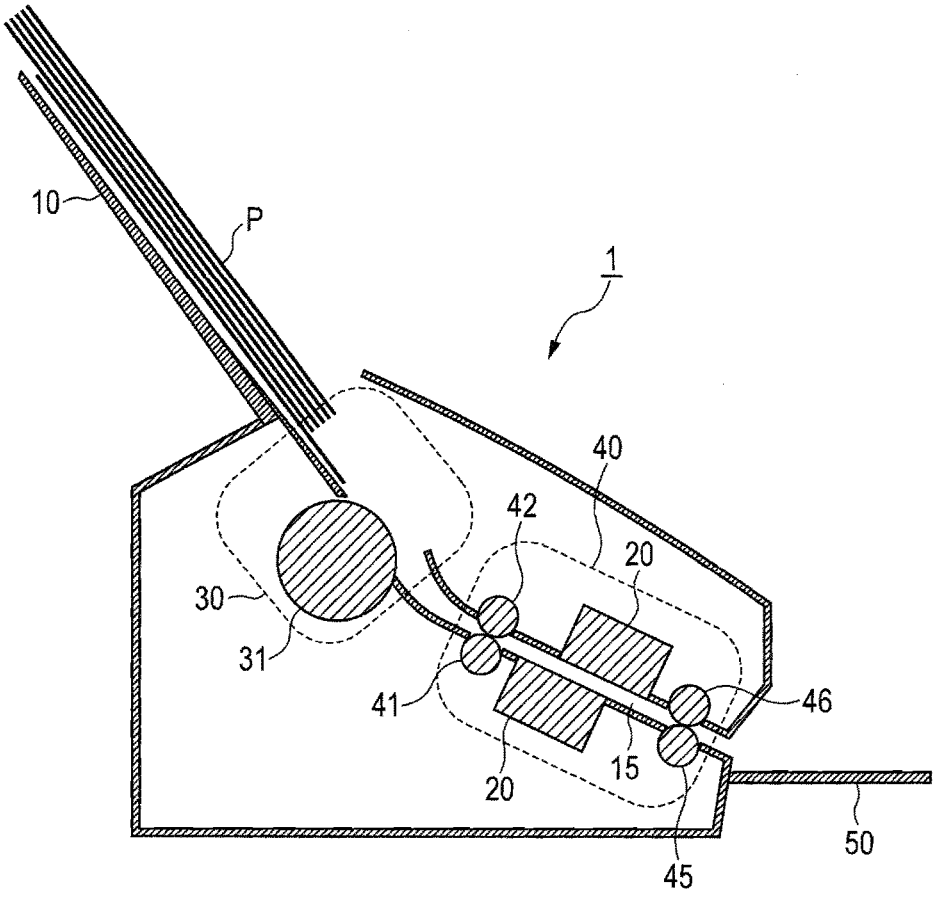
FIG. 1 is a schematic cross-sectional view showing an image reading apparatus.

As shown in FIG. 1, an image reading apparatus 1 of the present embodiment is a document scanner. The image reading apparatus 1 separates an original document P to be read (scanned), from an original document tray 10, one sheet at a time, conveys the original document P to a reading position at which line sensors 20 perform reading, and reads the original document P by using the line sensors 20. The image reading apparatus 1 performs the above-described process in accordance with a reading command from an external apparatus 3 (see FIG. 3), and supplies the external apparatus 3 with image data indicative a read image of the original document P.

The image reading apparatus 1 includes a separating mechanism 30 and a conveying mechanism 40 as a mechanism for conveying an original document P to the reading position. The separating mechanism 30 includes a separating roller 31 at a lower end of the original document tray 10. The separating roller 31 rotates to separate the lowermost sheet in contact with the separating roller 31 out of original documents P stacked on the original document tray 10, and to convey the separated sheet to the downstream side. The separating mechanism 30 may be provided with a known structure for appropriately separating original documents P one sheet at a time.

The conveying mechanism 40 is disposed downstream of the separating mechanism 30. The conveying mechanism 40 includes a first pair of rollers having a conveying roller 41 and a follow roller 42 and a second pair of rollers having a discharging roller 45 and a follow roller 46. These pairs of rollers are provided on a conveying path 15 of the original document P, and rotate to convey the original document P from upstream to downstream.

Figure 2A:
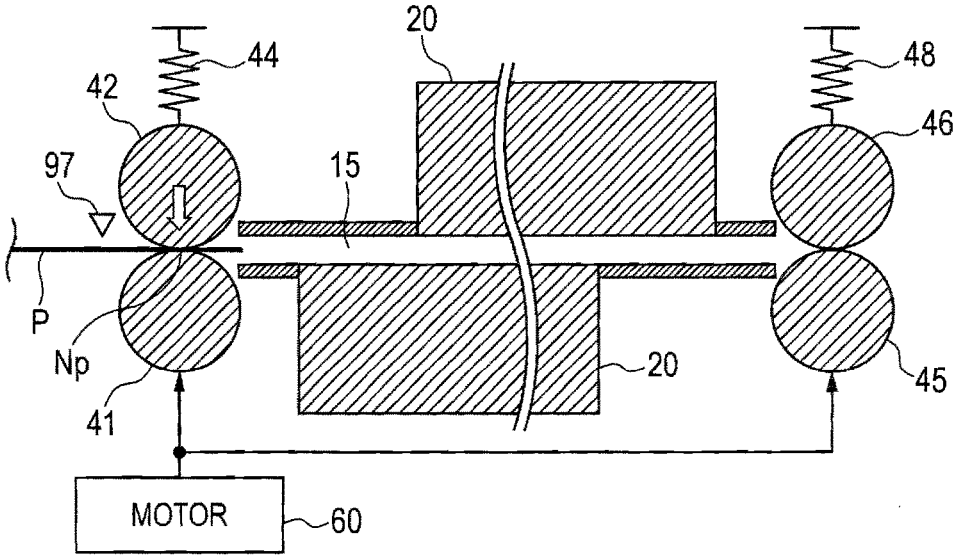
FIGS. 2A and 2B are schematic diagrams showing a configuration around a conveying roller and a discharging roller.
Figure 2B:
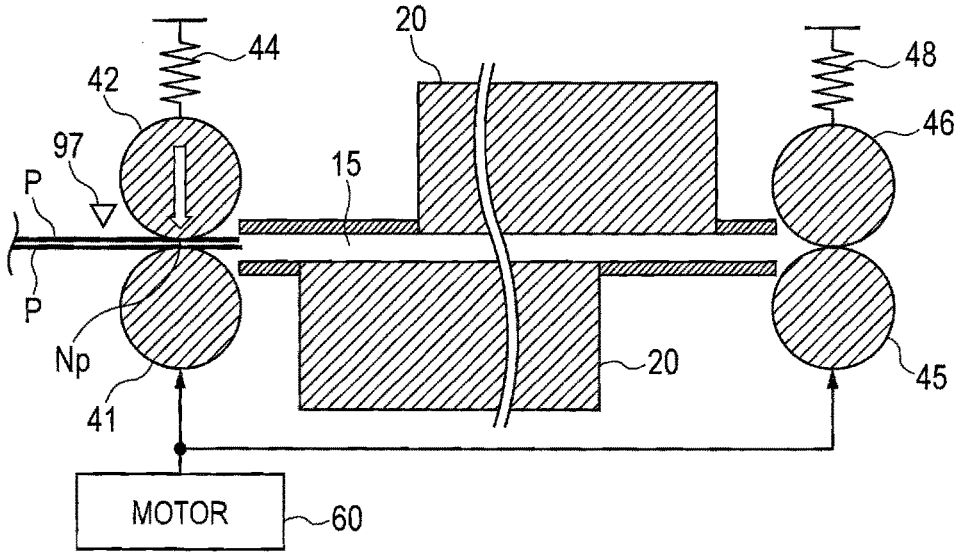

As shown in FIGS. 2A and 2B, a spring 44 for urging the follow roller 42 toward the conveying roller 41 is connected to a rotation shaft of the follow roller 42. Similarly, a spring 48 for urging the follow roller 46 toward the discharging roller 45 is connected to a rotation shaft of the follow roller 46.

Due to functions of the springs 44 and 48, the original document P is conveyed to a discharge tray 50 by rotations of the conveying roller 41 and the discharging roller 45, in a state where the original document P is nipped between the conveying roller 41 and the follow roller 42 and between the discharging roller 45 and the follow roller 46. The conveying roller 41 and the discharging roller 45 are driven to rotate by a same motor 60. The separating roller 31 is also driven to rotate by the motor 60. The motor 60 is a DC (direct current) motor.

The image reading apparatus 1 includes two line sensors 20. These line sensors 20 are known as CIS image sensors. The line sensors 20 are arranged at both side of the conveying path 15 at positions along the conveying path 15 between the conveying roller 41 and the discharging roller 45. That is, by having the two line sensors 20, the image reading apparatus 1 is configured to read both sides of the original document P.

Figure 3:
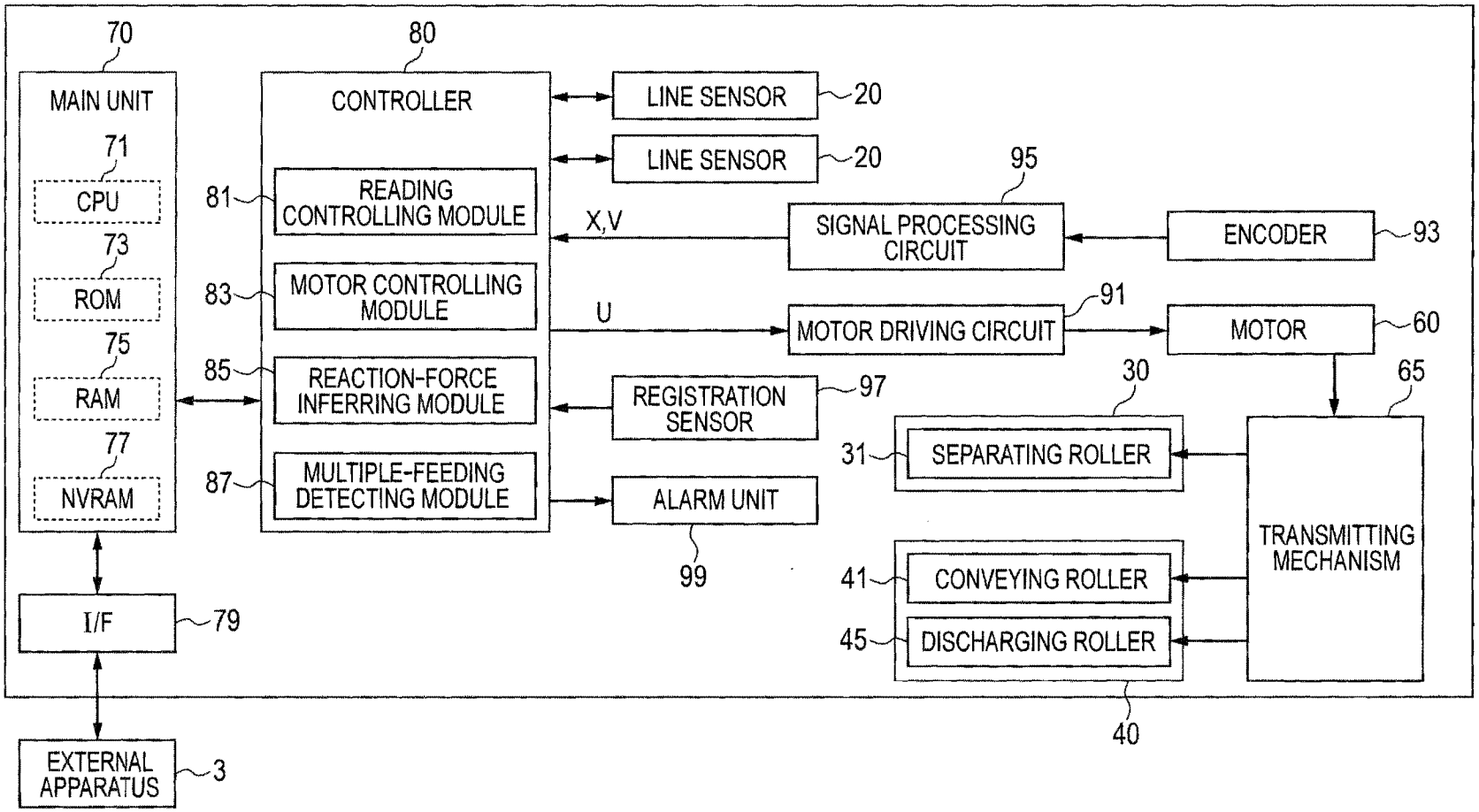
FIG. 3 is a block diagram showing an electrical configuration of the image reading apparatus.

Next, detailed configuration of the image reading apparatus 1 will be described. As shown in FIG. 3, the image reading apparatus 1 of the present embodiment includes a transmitting mechanism 65 that transmits power from the motor 60 to the separating roller 31, the conveying roller 41, and the discharging roller 45. The transmitting mechanism 65 has gears and so on that indirectly connect the motor 60 and the separating roller 31, that connect the motor 60 and the conveying roller 41, and that connect the conveying roller 41 and the discharging roller 45.

The image reading apparatus 1 further includes a main unit 70, a communication interface 79, a controller 80, a motor driving circuit 91, a rotary encoder 93, a signal processing circuit 95, a registration sensor 97, and an alarm unit 99.

The main unit 70 includes a CPU 71, a ROM 73, a RAM 75, and an NVRAM 77. The CPU 71 executes processes in accordance with programs stored in the ROM 73. The RAM 75 is used as a work area when the CPU 71 executes the processes. The NVRAM 77 is a nonvolatile memory that is electrically rewritable with data, and stores various data. The main unit 70 performs overall controls of the image reading apparatus 1 based on execution of various processes by the CPU 71 in order to realize necessary functions of the image reading apparatus 1.

The main unit 70 communicates with the external apparatus 3 via the communication interface 79, for example. Upon receiving a reading command from the external apparatus 3, the main unit 70 inputs a command to the controller 80 so as to perform a reading operation of the original document P based on this reading command.

Further, the main unit 70 provides the external apparatus 3, via the communication interface 79, with image data indicative of a read image of the original document P that is generated by the reading operation of the original document P. The external apparatus 3 is a personal computer, for example. The external apparatus 3 is operated by a user to input a reading command to the image reading apparatus 1. The communication interface 79 is a USB interface, for example.

The controller 80 receives various commands from the main unit 70. The controller 80 includes a reading controlling module 81, a motor controlling module 83, a reaction-force inferring module 85, and a multiple-feeding detecting module 87. Based on a command from the main unit 70, the reading controlling module 81 controls driving of the line sensors 20 so that the line sensors 20 perform a reading operation in conjunction with a conveying operation of the original document P. The reading controlling module 81 sequentially inputs, to the main unit 70, line data that are image data read for each line and generated by a reading operation of the line sensors 20. The main unit 70 combines these line data to generate the above-mentioned image data indicative of the read image of the original document P, and provides the generated image data to the external apparatus 3.

Based on a command from the main unit 70, the motor controlling module 83 controls driving of the motor 60 so as to control conveyance of the original document P from the original document tray 10 to the discharge tray 50.

Upon receiving a command from the main unit 70 based on the reading command from the external apparatus 3, the motor controlling module 83 controls driving of the motor 60 such that one sheet of the original document P is separated by rotation of the separating roller 31 and that this original document P is conveyed to a nipping position Np between the conveying roller 41 and the follow roller 42. After the original document P reaches the nipping position Np, the motor control ling module 83 controls driving of the motor 60 such that the original document P passes between the line sensors 20 at a constant speed. Specifically, the motor controlling module 83 calculates a manipulated variable U as a current command value U for the motor 60 based on a detected conveying speed V of the original document P, and inputs a PWM signal corresponding to the manipulated variable U to the motor driving circuit 91, thereby performing feedback control of the conveying speed V of the original document P.

In addition, an encoder disk is provided at the rotation shaft of the motor 60. The rotary encoder 93 includes the encoder disk and a sensor for reading (detecting) a slit of the encoder disk. Based on an input signal from the rotary encoder 93 (more specifically, sensor), the signal processing circuit 95 detects a rotation amount X and a rotational speed V of the motor 60, and inputs the detected values to the controller 80. The motor controlling module 83 calculates such manipulated variable U that the rotational speed V of the motor 60 inputted from the signal processing circuit 95 becomes constant at a target speed, and inputs a corresponding PWM signal to the motor driving circuit 91. In accordance with this PWM signal, the motor driving circuit 91 applies a drive current corresponding to the manipulated variable U to the motor 60. Note that the rotational speed V of the motor 60 can be regarded as the conveying speed V of the original document P.

The reaction-force inferring module 85 is configured to infer reaction force that acts on the motor 60 from the original document P, based on the manipulated variable U which is a control input and on the rotational speed V of the motor 60 which is a control output. The multiple-feeding detecting module 87 detects multiple feeding of the original document P based on a reaction-force inference value R that is an inference value of reaction force obtained by the reaction-force inferring module 85. Here, "multiple feeding" means that one sheet of the original document P is not accurately separated by the separating roller 31, and that a plurality of sheets of the original document P is conveyed toward the conveying roller 41 together.

As shown in FIG. 2B, in a case where multiple feeding occurs, a plurality of sheets of the original document P enters together between the conveying roller 41 and the follow roller 42. Hence, as indicated by arrows in FIGS. 2A and 2B, urging force of the spring 44 in a case where multiple feeding occurs (FIG. 2B) is greater than urging force of the spring 44 in a case where multiple feeding does not occur (FIG. 2A). Due to this increase of the urging force, force acting on the rotation shaft of the conveying roller 41 increases. Thus, friction force at the bearing of the shaft of the conveying roller 41 in a case where multiple feeding occurs is greater than the friction force in a case where multiple feeding does not occur. In the present embodiment, this phenomenon is used to detect multiple feeding based on the reaction-force inference value R.

The multiple-feeding detecting module 87 detects that the original document P reaches the nipping position Np between the conveying roller 41 and the follow roller 42, based on an output signal from the registration sensor 97. The registration sensor 97 is disposed adjacent to the nipping position Np on the conveying path 15 between the nipping position Np and the separating roller 31. The registration sensor 97 outputs an ON signal when the original document P exists at a position where the registration sensor 97 is disposed, and outputs an OFF signal when the original document P does not exist at the position where the registration sensor 97 is disposed. The multiple-feeding detecting module 87 detects multiple feeding of the original document P based on the reaction-force inference value R after detecting the original document P reaches the nipping position Np. If multiple feeding occurs, the multiple-feeding detecting module 87 drives the alarm unit 99 to output alarming sound so as to notify the user that multiple feeding occurs (the details will be described later).

Figure 4:
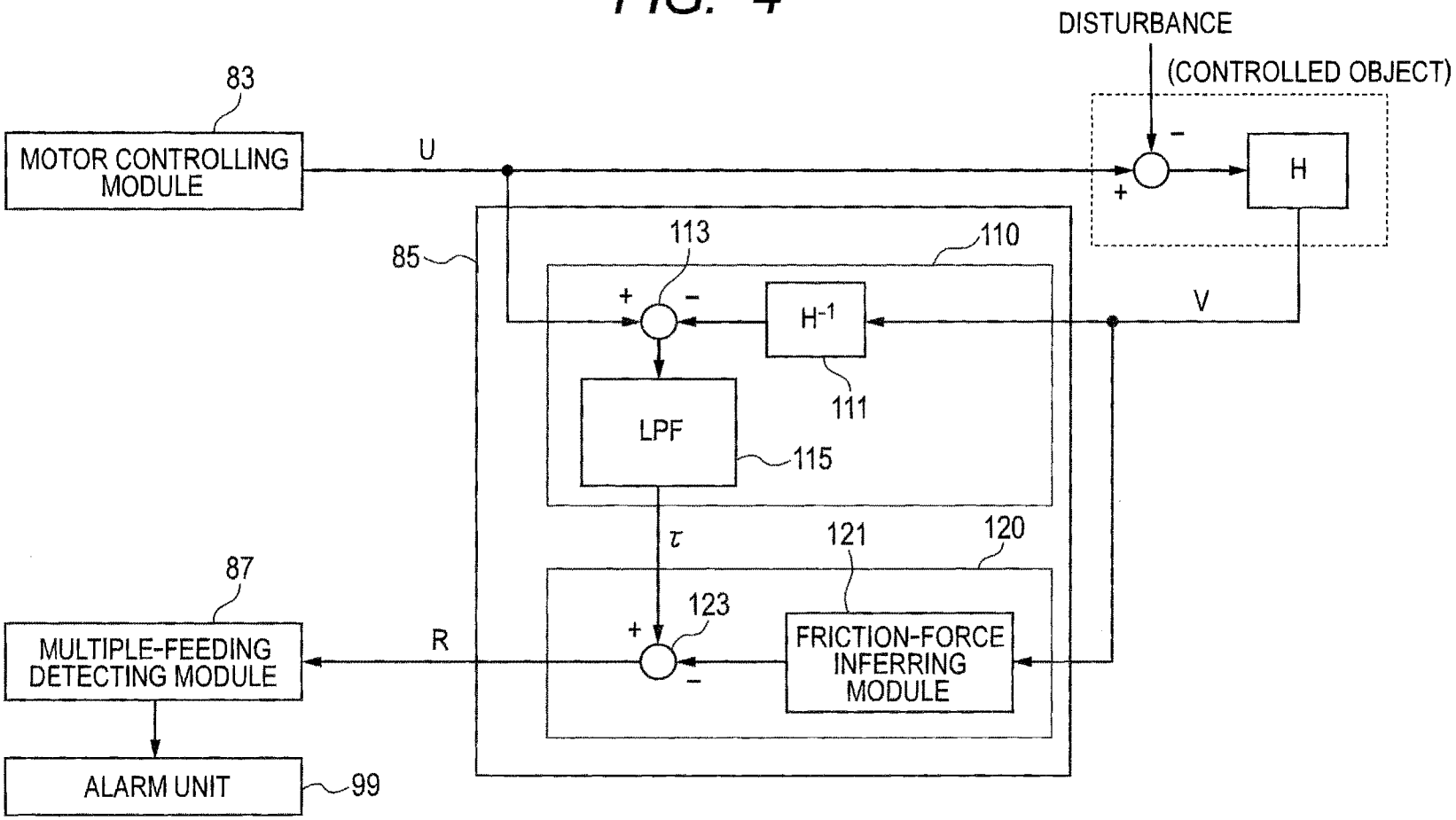
FIG. 4 is a block diagram showing a configuration of a reaction-force inferring section.

Next, the detailed configuration of the reaction-force inferring module 85 will be described while referring to FIG. 4. The reaction-force inferring module 85 includes a disturbance observer 110 and an inferring module 120. The disturbance observer 110 infers disturbance that acts on a controlled object. The controlled object corresponds to a transfer system from input of the manipulated variable U to the motor driving circuit 91 to detection of a control output (the speed V) by the signal processing circuit 95. The disturbance observer 110 includes an inverse-model arithmetic section 111, a subtracter 113, and a low-pass filter 115.

The inverse-model arithmetic section 111 converts the speed V detected by the signal processing circuit 95 into the corresponding manipulated variable U*, by using a transfer function $H^{-1}$ of an inverse model corresponding to a transfer model of the controlled object. The transfer function $H^{-1}$ is defined by expressing, by a rigid model, an input-output characteristic model H showing relationship between a control output and a control input. Specifically, the transfer function $H^{-1}$ is defined as $H^{-1}=J\cdot s$ that is an inverse obtained when the input-output characteristic model H is expressed as $H=1/(J\cdot s)$ by using a constant "J" and Laplace operator "s".

The subtracter 113 calculates a deviation (U−U*) between the manipulated variable U and the manipulated variable U* that is calculated by the inverse-model arithmetic section 111. The low-pass filter 115 removes high-frequency components from the deviation (U−U*). The low-pass filter 115 of the present embodiment is a first-order low-pass filter having a cutoff frequency we that is expressed by a transfer function $G=\omega c/(s+\omega c)$. Note that the low-pass filter 115 may be n-th order low-pass filter that is expressed by a transfer function $G=(\omega c/(s+\omega c))^n$.

The disturbance observer 110 outputs, as a disturbance inference value T, the deviation (U−U*) after the high-frequency components are removed by the low-pass filter 115. The unit of the deviation (U−U*) is ampere (A) since the manipulated variable U indicates a current command value. When a DC motor is the power source, there is a proportional relationship between ampere (current) and torque (reaction force). Hence, the deviation (U−U*) indirectly indicates force acting on the motor 60 as disturbance.

The inferring module 120 calculates an inference value R of reaction force that acts on the motor 60 from the original document P, based on the disturbance inference value τ. The disturbance inference value τ includes a viscous friction component and a dynamic friction component due to rotation of the motor 60, the components being independent of the original document P. The inferring module 120 removes the viscous friction component and the dynamic friction component from the disturbance inference value τ, thereby calculating the reaction-force inference value R that is attributable to the original document P.

For example, the inferring module 120 includes a friction-force inferring module 121 and a subtracter 123. The friction-force inferring module 121 infers a friction component included in the disturbance inference value τ, that is independent of the original document P. The subtracter 123 subtracts the friction component from the disturbance inference value τ, thereby calculating the reaction-force inference value R. The friction-force inferring module 121 multiplies the rotational speed V of the motor 60 by a predetermined coefficient γ, thereby calculating an inference value (γ·V) of the viscous friction component (the viscous friction component that is dependent on the speed V). And, the inference value (γ·V) is added to an inference value F of the dynamic friction component at the time when the original document P is not conveyed (the dynamic friction component that is independent from the speed V), thereby calculating an inference value (γ·V+F) of the above-mentioned friction component. The reaction-force inference value R calculated by the inferring module 120 is inputted to the multiple-feeding detecting module 87.

Next, processes performed by the multiple-feeding detecting module 87 will be described while referring to the flowchart shown in FIG. 5. The multiple-feeding detecting module 87 is configured to perform processes shown in FIG. 5 by software and/or hardware.

Figure 5:
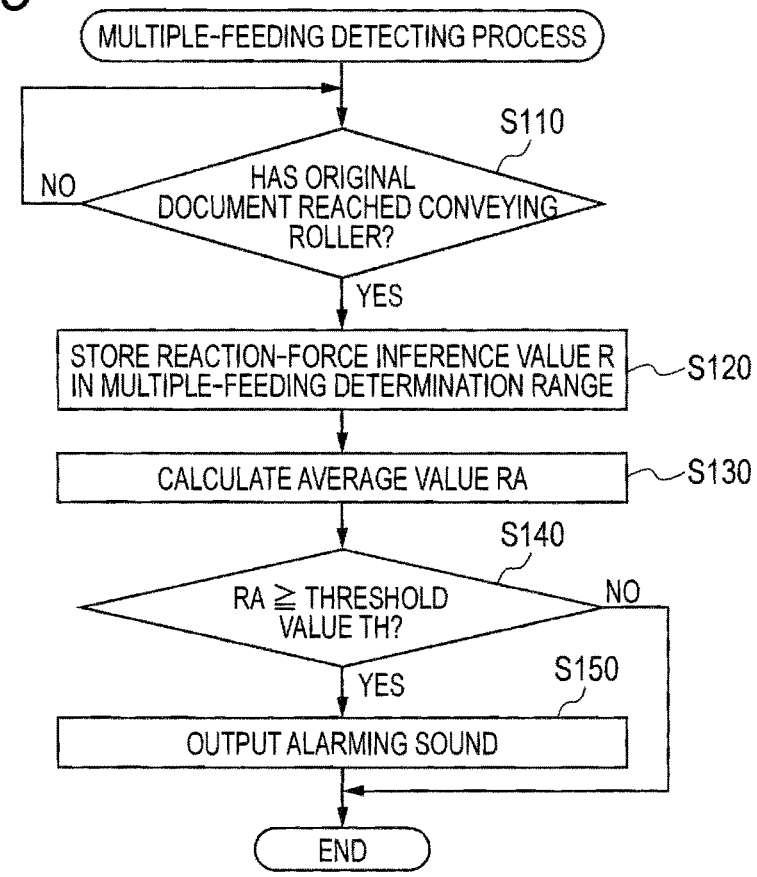
FIG. 5 is a flowchart showing a multiple-feeding detecting process executed by a multiple-feeding detecting section according to a first embodiment.

The multiple-feeding detecting module 87 starts a multiple-feeding detecting process shown in FIG. 5, each time the motor controlling module 83 starts a conveying operation of the original document P from the original document tray 10 in accordance with a command from the main unit 70. Upon starting the multiple-feeding detecting process, the multiple-feeding detecting module 87 waits until the original document P conveyed from the original document tray 10 reaches the conveying roller 41 (S110). Specifically, the multiple-feeding detecting module 87 waits until the original document P reaches the nipping position Np between the conveying roller 41 and the follow roller 42. This determination of whether the original document P has reached the nipping position Np is performed based on an output signal of the registration sensor 97.

For example, when the output signal of the registration sensor 97 switches to an ON signal from an OFF signal, the multiple-feeding detecting module 87 determines that the original document P has reached the conveying roller 41. If a distance from the registration sensor 97 to the nipping position Np is not negligible, the multiple-feeding detecting module 87 determines a conveying amount of the original document P after the output signal of the registration sensor 97 switches to an ON signal from an OFF signal, based on the rotation amount X obtained from the signal processing circuit 95. Then, the multiple-feeding detecting module 87 determines whether the original document P has reached the conveying roller 41, based on the conveying amount of the original document P.

If it is determined that the original document P has reached the conveying roller 41 (S110: Yes), the multiple-feeding detecting module 87 stores the reaction-force inference value R that is calculated by the reaction-force inferring module 85 in a multiple-feeding determination range (S120). Here, the multiple-feeding determination range is defined by using, as a reference, a reaching time point T0 at which the original document P reaches the conveying roller 41.

The multiple-feeding determination range is defined as a range having a starting point at or after a time point when the reaction-force inference value R converges to an approximately constant value after the reaction-force inference value R increases due to the original document P's entering the nipping position Np. The constant value corresponds to reaction force at a time point when the original document P enters the nipping position Np.

Figure 6:
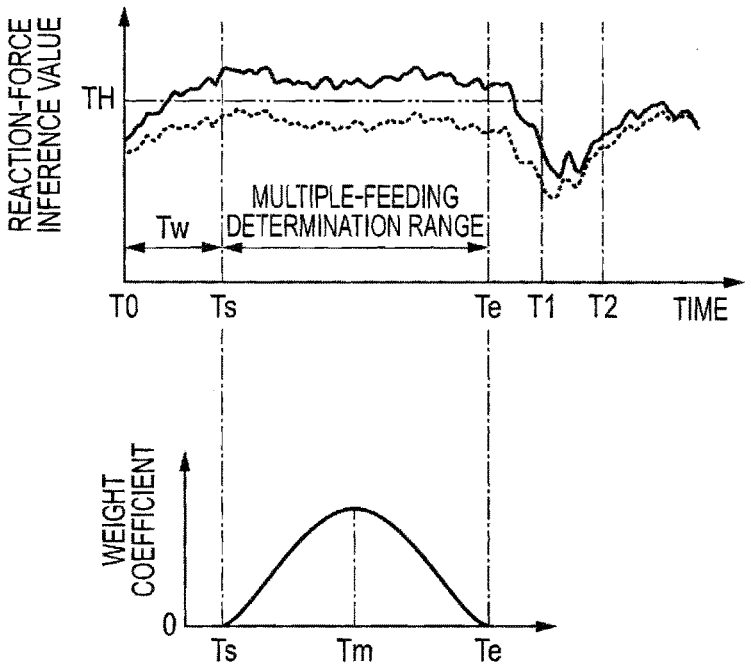
FIG. 6 includes graphs showing changes of a reaction-force inference value and a multiple-feeding determination range of the first embodiment.

As shown in FIG. 6, the reaction-force inference value R changes at a delayed timing from the reaching time point T0 at which the original document P reaches the conveying roller 41. This delay period is a time period corresponding to the cutoff frequency we of the low-pass filter 115. Hence, a starting point (starting time point) Ts of the multiple-feeding determination range is not the time point T0, but a time point that is delayed from the time point T0 by a predetermined waiting period Tw. The dotted curve in FIG. 6 indicates changes of the reaction-force inference value R when multiple feeding does not occur, and the solid curve indicates changes of the reaction-force inference value R when multiple feeding occurs.

Figure 7:
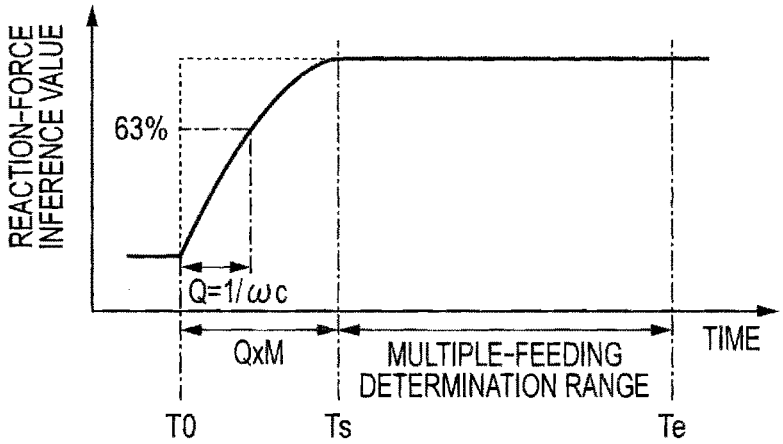
FIG. 7 is a diagram for illustrating a method of setting the multiple-feeding determination range of the first embodiment.

As shown in FIG. 7, for example, the waiting period Tw is a value Q×M that is obtained by multiplying the time constant $Q=1/\omega c$ of the low-pass filter 115 by a predetermined value (M times). The dotted lines in FIG. 7 indicate changes of reaction force that actually acts on the motor 60, and the solid curve indicates changes of the reaction-force inference value R. In FIG. 7, the reaction-force inference value R (the solid curve) converges at the time point Ts and, after that, the dotted lines and the solid curve overlap each other.

It can be understood that the change of reaction force acting on the conveying roller 41 occurs approximately at a moment when the original document P enters the nipping position Np between the conveying roller 41 and the follow roller 42. Accordingly, it can be said that a time point when a period corresponding to the time constant Q elapses after the time point T0 is approximately the same as a time point when the reaction-force inference value R reaches $(1-e^{-1})$ times (approximately 63%) of an actual amount of change of reaction force from the reaction-force inference value R at the time point T0.

Accordingly, the waiting period Tw may be defined as a value that is obtained by multiplying the time constant Q by a coefficient such as M=5/3 (times). It is noted that M is approximately equal to $(63/100)^{-1}$. Then, the starting point Ts of the multiple-feeding determination range is set to a time point approximately when the reaction-force inference value R converges to a constant value. Fluctuation factors of the reaction-force inference value R are generated at a time point T1 at which the leading end of the original document P reaches the discharging roller 45, and at a time point T2 at which the trailing end of the original document P passes the conveying roller 41. Thus, preferably, an ending point (ending time point) Te of the multiple-feeding determination range is set to a time point prior to the time point T1 at which the leading end of the original document P reaches the discharging roller 45. The time point T1 may be obtained, for example, by adding a time point measured by the registration sensor 97 to a sensor-roller distance divided by a target conveying speed, the sensor-roller distance being a distance between the registration sensor 97 and the discharging roller 45.

In this way, the multiple-feeding detecting module 87 stores the reaction-force inference value R in a period from a time point Ts to a time point Te. Here, the time point Ts is a time point when the predetermined waiting period Tw elapses from the time point T0 at which it is determined that the original document P reaches the conveying roller 41. After that, the multiple-feeding detecting module 87 calculates an average value RA of the reaction-force inference value R in the multiple-feeding determination range (S130).

The average value RA calculated here may be a simple average, or may be a weighted average. Weight coefficients W used for calculating the weighted average may be in accordance with a function shown in the lower part of FIG. 6. This function has a minimum value W=0 at the time point Ts and at the time point Te, has a maximum value at a middle point Tm (the middle point is a temporal center point between the time point Ts and the time point Te), and smoothly and monotonically increases or decreases between the minimum value and the maximum value. That is, the average value RA may be a weighted average that is obtained by applying a window function shown in the lower part of FIG. 6 to the reaction-force inference value R in the multiple-feeding determination range.

After calculating the average value RA, the multiple-feeding detecting module 87 determines whether the average value RA is larger than or equal to a preset threshold value TH (S140). If it is determined that the average value RA is larger than or equal to the threshold value TH (S140: Yes), the process advances to S150. In S150, the multiple-feeding detecting module 87 controls the alarm unit 99 to output alarming sound, by assuming that multiple feeding of the original document P occurs (S150). Then, the multiple-feeding detecting module 87 ends the multiple-feeding detecting process.

On the other hand, if it is determined that the average value RA is smaller than the threshold value TH (S140: No), the multiple-feeding detecting module 87 ends the multiple-feeding detecting process without driving the alarm unit 99.

According to the image reading apparatus 1 of the present embodiment as described above, the image reading apparatus 1 detects occurrence of multiple feeding based on the reaction-force inference value R. The reaction-force inference value R is calculated by removing the friction components from the disturbance inference value t that is calculated from both the control input (the manipulated variable U) and the control output (the speed V). And, if multiple feeding occurs, the image reading apparatus 1 outputs alarming sound so as to notify (warn) the user of occurrence of multiple feeding.

Specifically, the image reading apparatus 1 outputs alarming sound when the average value RA of the reaction-force inference value R is larger than or equal to the threshold value TH. Here, the average value RA is an average value in the multiple-feeding determination range after the original document P enters the nipping position Np of the conveying roller 41. Thus, according to the present embodiment, even without providing a dedicated force transducer for detecting multiple feeding as in a conventional art, alarming sound can be outputted in response to occurrence of multiple feeding of the original document P.

Especially, in the present embodiment, considering that the reaction-force inference value R has a delay depending on the cutoff frequency we or the time constant Q=(1/ωc) of the low-pass filter 115, the starting point Ts of the multiple-feeding determination range is set to a time point when the predetermined waiting period Tw elapses after the original document P reaches the conveying roller 41. Here, the waiting period Tw depends on the time constant Q. Thus, according to the present embodiment, multiple feeding can be detected accurately and alarming sound can be outputted, while suppressing effects of a delay caused by the low-pass filter 115.

In addition, in an example in which the average value RA is calculated as a weighted average that weight coefficients decrease from the temporal center toward the both ends of the multiple-feeding determination range, multiple feeding can be detected even more accurately while suppressing effects by cyclic variations of the reaction-force inference value R.

That is, when the original document P is conveyed by rotation of the conveying roller 41, there is a possibility that the reaction-force inference value R includes cyclic variations due to rotation of the conveying roller 41. If the average value RA is a simple average in this case, there is a possibility that variations occur in the average value RA depending on relationship between the multiple-feeding determination range and the frequency and the phase of the above-mentioned variations. In contrast, in this example, the weighted average is calculated as the average value RA by using a window function. The above-mentioned variations of the average value RA can be suppressed, and reaction force due to the original document P can be evaluated appropriately based on the average value RA. Accordingly, multiple feeding can be detected accurately, and erroneous occurrence of alarming sound can be suppressed.

Note that the motor controlling module 83 may be configured to, upon detecting multiple feeding, stop the motor 60 immediately so as to stop conveying the original document P. Such motor control can suppress occurrence or progress of jam caused by multiple feeding of the original document P.

Incidentally, in the above-described embodiment, occurrence of multiple feeding is detected by comparing the average value RA of the reaction-force inference value R in the multiple-feeding determination range with the threshold value TH. However, instead of using the average value RA, a statistical value, such as a median and a mode of the reaction-force inference value R, may be used. The median and the mode are also standard values of the reaction-force inference value R in the multiple-feeding determination range, and multiple feeding can also be detected accurately by using these values.

Further, in the above-described the embodiment, the starting point Ts of the multiple-feeding determination range is set to a time point (T0+M×Q) when a time period corresponding to M (M>1) times the time constant Q elapses from the time point T0. However, the starting point Ts of the multiple-feeding determination range may be set to a time point (T0+Q) when a time period corresponding to the time constant Q elapses from the time point T0.

Further, in the above-described the embodiment, the ending time point Te of the multiple-feeding determination range is set to a time point prior to the time point T1 at which the leading end of the original document P reaches the discharging roller 45. However, the ending time point Te may be set to a time point prior to the time point T2 at which the trailing end of the original document P passes the conveying roller 41.

Further, the threshold value TH may be updated by a learning process. For example, if alarming sound is outputted due to erroneous detection of multiple feeding in spite a fact that multiple feeding does not occur, information indicative of erroneous detection can be acquired from the external apparatus 3 by a user's operation. Based on this information, the threshold value TH may be updated in a direction of suppressing erroneous detection.

Further, the image reading apparatus 1 may be configured to set the threshold value TH that is specified by the external apparatus 3. As another example, the image reading apparatus 1 may be configured to acquire, from the external apparatus 3, information indicative of a kind of the original document P, such as thick paper and normal paper, and to set the threshold value TH depending on the kind of the original document P. As still another example, the threshold value TH may be set based on the reaction-force inference value R before the original document P reaches the conveying roller 41.

Second Embodiment

Next, a second embodiment will be described. The image reading apparatus 1 of the second embodiment has basically the same configuration as the image reading apparatus 1 of the first embodiment, except that the multiple-feeding detecting module 87 executes a multiple-feeding detecting process shown in FIG. 8 instead of the multiple-feeding detecting process shown in FIG. 5. Accordingly, in the following descriptions, the multiple-feeding detecting process shown in FIG. 8 will be described selectively. Like parts and components are designated by the same reference numerals to avoid duplicating description.

Upon starting the multiple-feeding detecting process, similarly to S110, the multiple-feeding detecting module 87 waits until the original document P reaches the conveying roller 41 (S210). And, when the original document P reaches the conveying roller 41 (S210: Yes), the multiple-feeding detecting module 87 stores the reaction-force inference value R calculated by the reaction-force inferring module 85 in a multiple-feeding determination range. This multiple-feeding determination range is defined by using, as the reference, the reaching time point T0 at which the original document P reaches the conveying roller 41 (S220).

In the present embodiment, however, the multiple-feeding detecting module 87 stores the reaction-force inference value R in the multiple-feeding determination range different from that in the first embodiment, in order to detect multiple feeding of the original document P based on a rate of change (slope) K of the reaction-force inference value R.

Figure 9A:
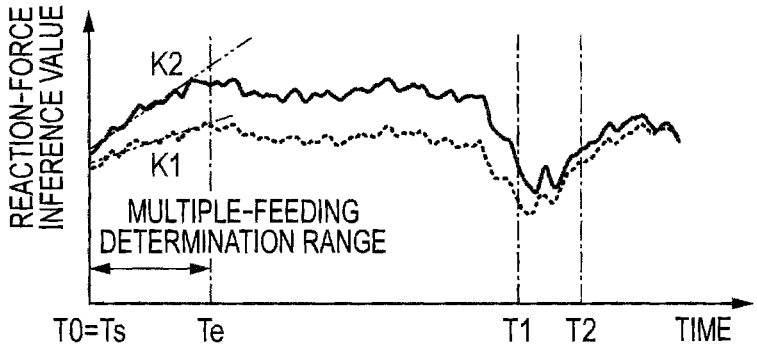
FIG. 9A is a diagram showing a multiple-feeding determination range of the second embodiment.

In the first embodiment, the multiple-feeding determination range is defined as a range after the reaction-force inference value R converges to an approximately constant value. In the present embodiment, however, as shown in FIG. 9A, the multiple-feeding determination range is defined as a range before a time point at which the reaction-force inference value R converges. In the graph shown in FIG. 9A, in a similar manner to FIG. 6, the dotted curve indicates changes of the reaction-force inference value R when multiple feeding does not occur, and the solid curve indicates changes of the reaction-force inference value R when multiple feeding occurs.

Figure 9B:
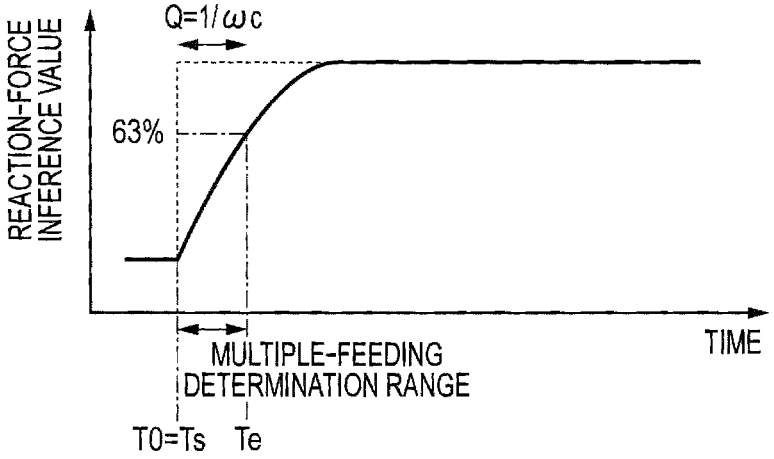
FIG. 9B is a diagram for illustrating a method of setting the multiple-feeding determination range of the second embodiment.

As shown in FIG. 9B, for example, the multiple-feeding determination range of the present embodiment is defined as a range having a starting point Ts and an ending point Te. Here, the starting point Ts is the reaching time point T0 at which the original document P reaches the conveying roller 41. The ending point Te is a time point (T0+Q) at which a time period corresponding to the time constant Q of the low-pass filter 115 elapses from the time point T0. That is, the multiple-feeding determination range is defined as a range from a time point when the original document P reaches the nipping position Np between the conveying roller 41 and the follow roller 42 and hence the reaction-force inference value R starts increasing, until a time point when a time period corresponding to the time constant Q elapses (that is, until a time point when or before the reaction-force inference value R converges). The dotted lines in FIG. 9B indicate changes of reaction force that acts on the motor 60, and the solid curve indicates changes of the reaction-force inference value R. In FIG. 9B, the reaction-force inference value R (the solid curve) converges at a certain time point and, after that, the dotted lines and the solid curve overlap each other.

After storing the above-described reaction-force inference value R in the multiple-feeding determination range from the time point T0 (S220), the multiple-feeding detecting module 87 calculates a rate of change K of the reaction-force inference value R in the multiple-feeding determination range (S230). For example, the rate of change K can be calculated by approximating, by a linear function, trajectory of the reaction-force inference value R in the multiple-feeding determination range by using a least-square method.

Subsequently, the multiple-feeding detecting module 87 determines whether the rate of change K is larger than or equal to a preset threshold value TH (S240). If it is determined that the rate of change K is larger than or equal to the threshold value TH (S240: Yes), the multiple-feeding detecting module 87 controls the alarm unit 99 to output alarming sound by assuming that multiple feeding of the original document P occurs (S250). Then, the multiple-feeding detecting module 87 ends the multiple-feeding detecting process. On the other hand, if it is determined that the rate of change K is smaller than the threshold value TH (S240: No), the multiple-feeding detecting module 87 ends the multiple-feeding detecting process without driving the alarm unit 99. The threshold value TH may be set to a value that is larger than a rate of change K1 when multiple feeding does not occur and that is smaller than a rate of change K2 when multiple feeding occurs.

As described above, according to the image reading apparatus 1 of the second embodiment, similarly to the first embodiment, occurrence of multiple feeding can be detected without using a force transducer, and alarming sound can be outputted. Especially, according to the method of detecting multiple feeding based on the rate of change K in the range from the time point T0 until a time period corresponding to the time constant Q elapses, there tend to be a difference in the rate of change K depending on whether multiple feeding occurs, and hence multiple feeding can be detected accurately.

Figure 8:
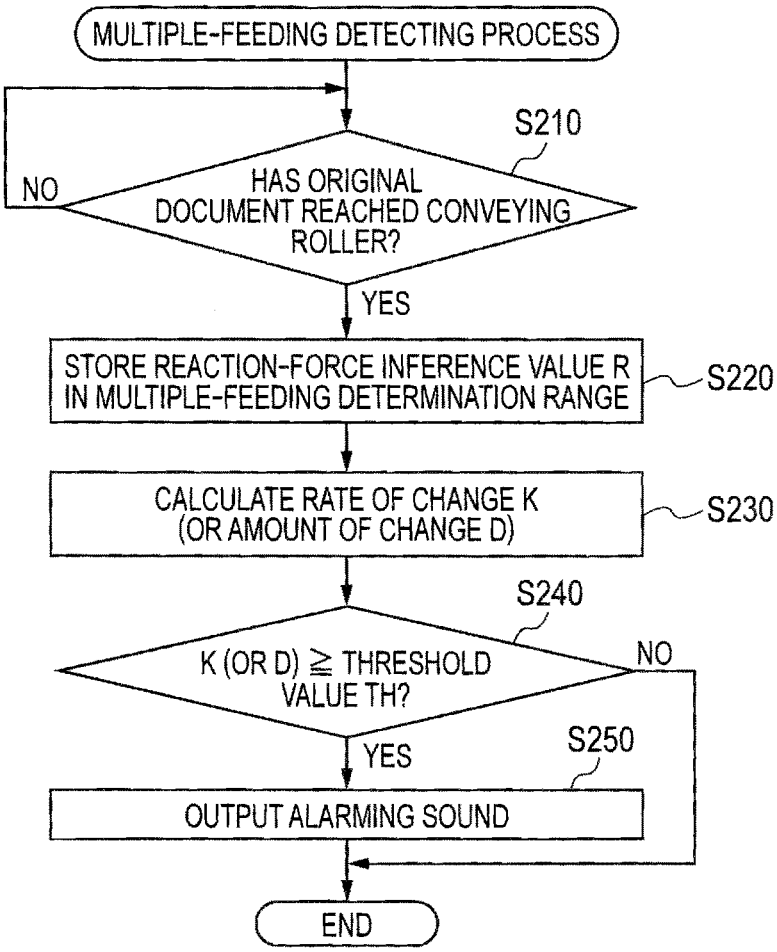
FIG. 8 is a flowchart showing a multiple-feeding detecting process according to a second embodiment.

Incidentally, in S230 of the multiple-feeding detecting process shown in FIG. 8, an amount of change D of the reaction-force inference value R in the multiple-feeding determination range may be calculated, instead of calculating the rate of change K. The amount of change D may be the absolute value of the deviation between the reaction-force inference value R at the starting point Ts of the multiple-feeding determination range and the reaction-force inference value R at the ending point Te of the multiple-feeding determination range. Or, the amount of change D may be the absolute value of the deviation between the reaction-force inference value R immediately before the original document P reaches the conveying roller 41 and the reaction-force inference value R at the ending point Te in multiple-feeding determination range.

Figure 10:
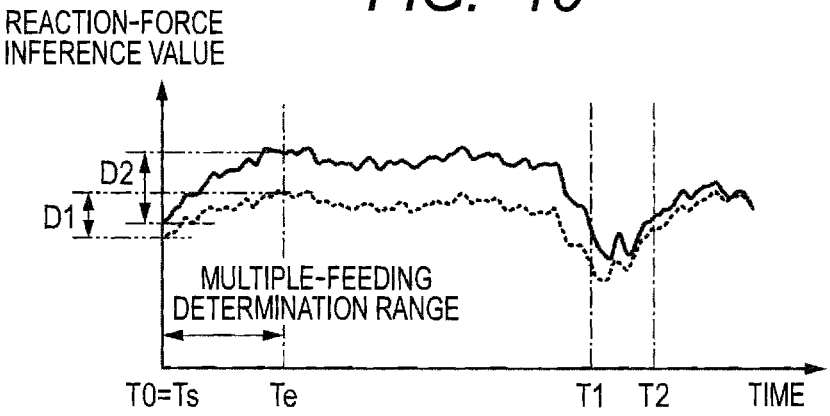
FIG. 10 is a diagram for illustrating a method of detecting multiple feeding based on amounts of change of a reaction-force inference value.

In FIG. 10, an amount of change D1 indicates the amount of change D when multiple feeding does not occur, and an amount of change D2 indicates the amount of change D when multiple feeding occurs. Similarly to FIGS. 6 and 9, the dotted curve indicates changes of the reaction-force inference value R when multiple feeding does not occur, and the solid curve indicates changes of the reaction-force inference value R when multiple feeding occurs. As can be understood from FIG. 10, the amount of change D has large values when multiple feeding occurs.

In S240, the multiple-feeding detecting module 87 determines whether the amount of change D is larger than or equal to a threshold value TH. If the amount of change D is larger than or equal to the threshold value TH, the multiple-feeding detecting module 87 drives the alarm unit 99 to output alarming sound.

When multiple feeding occurs, larger reaction force is generated than a case where multiple feeding does not occur, and hence the changes of the reaction-force inference value R become larger. Accordingly, by detecting occurrence of multiple feeding and outputting alarming sound based on comparison between the amount of change D of the reaction-force inference value R and the threshold value TH, alarming sound can be outputted accurately in response to occurrence of multiple feeding, with simple processes.

While the invention has been described in detail with reference to the above aspects thereof, it would be apparent to those skilled in the art that various changes and modifications may be made therein without departing from the scope of the claims.

The invention is not limited to an application to the image reading apparatus, but also can be applied to various apparatuses in which multiple feeding of sheets may occur. For example, the invention can be applied to an image forming apparatus (an inkjet printer and so on) that separates sheets from a sheet feeding tray one sheet at a time and that forms an image on the separated sheet.

In the above-described embodiment, if multiple feeding occurs, the multiple-feeding detecting module 87 drives the alarm unit 99 to output alarming sound. However, the method of warning is not limited to this. For example, the alarm unit 99 may be a display unit, and the multiple-feeding detecting module 87 may control the alarm unit 99 to display alarm, instead of alarming sound. Or, the multiple-feeding detecting module 87 may control a display unit of the external apparatus 3 to display alarm.

The pair of the conveying roller 41 and the follow roller 42 is an example of a pair of nipping members. The controller 80 is an example of a controller. Steps S110 and S210 executed by the multiple-feeding detecting module 87 are examples of a reaching determining process, and steps S120 to S150 and S220 to S250 are examples of a warning process.

What is claimed is:

1. A sheet conveying apparatus comprising:

a motor;

a conveying mechanism having a pair of nipping members configured to nip a sheet from both sides thereof at a nipping position and to convey the sheet from an upstream side to a downstream side, the pair of nipping members comprising a conveying roller configured to be rotated by the motor;

an encoder arranged to detect rotation of the motor; and a controller configured to perform:

a reaching determining process of determining whether the sheet has reached the nipping position;

a motor controlling process of calculating a control input and of inputting the calculated control input to the motor, thereby controlling the motor to perform a conveying operation of the sheet by rotation of the conveying roller;

a measuring process of measuring a control output outputted by the motor, based on the rotation detected by the encoder;

a reaction-force calculating process including:

calculating output of an inverse model by inputting the control output measured by the measuring process to the inverse model, the inverse model being an inverse model of a characteristic model of the control output relative to the control input;

calculating a deviation between the output of the inverse model and the control input;

calculating a filter output by inputting the deviation to a filter configured to attenuate a high-frequency component; and calculating a reaction-force inference value by removing a friction component from the filter output, the reaction-force inference value corresponding to reaction force that acts on the motor, the friction component being generated due to the rotation of the motor; and a warning process of outputting warning in response to occurrence of multiple feeding of the sheet, based on the reaction-force inference value, the warning process including:

calculating a standard value of the reaction-force inference value in a particular period after it is determined in the reaching determining process that the sheet has reached the nipping position; and outputting the warning when the standard value is larger than or equal to a threshold value, wherein a starting time point of the particular period is a time point at which a waiting period elapses after it is determined that the sheet has reached the nipping position, the waiting period being a time period that is obtained by multiplying a time constant of the filter by a constant greater than or equal to one (1).

2. The sheet conveying apparatus according to claim 1, wherein, in the warning process, the controller is configured to output the warning when the reaction-force inference value is larger than or equal to a particular level after the sheet enters the nipping position.

3. The sheet conveying apparatus according to claim 1, wherein the particular period is a time period defined based on the time constant of the filter, the particular period being a time period after a convergence time point, the convergence time point being a time point at which the reaction-force inference value converges after the reaction-force inference value starts increasing when the sheet reaches the nipping position.

4. The sheet conveying apparatus according to claim 3, wherein the conveying mechanism further comprises a downstream-side roller disposed at the downstream side of the conveying roller; and wherein an ending time point of the particular period is a time point before a leading end of the sheet reaches the downstream-side roller.

5. The sheet conveying apparatus according to claim 3, wherein the conveying mechanism further comprises a downstream-side roller disposed at the downstream side of the conveying roller; and wherein the particular period is defined between a first time point and a second time point, the first time point being a time point at which the waiting period elapses after the reaction-force inference value starts increasing when the sheet reaches the nipping position, the second time point being a time point before a leading end of the sheet reaches the downstream-side roller.

6. The sheet conveying apparatus according to claim 5, wherein the waiting period is a time period corresponding to the time constant of the filter.

7. The sheet conveying apparatus according to claim 3, wherein the particular period is defined between a first time point and a second time point, the first time point being a time point at which the waiting period elapses after the reaction-force inference value starts increasing when the sheet reaches the nipping position, the second time point being a time point before a trailing end of the sheet passes the nipping position.

8. The sheet conveying apparatus according to claim 1, wherein the control input is a current command value supplied to the motor; and wherein the control output is a rotational speed of the motor.

9. A sheet conveying apparatus comprising:

a motor;

a conveying mechanism having a pair of nipping members configured to nip a sheet from both sides thereof at a nipping position and to convey the sheet from an upstream side to a downstream side, the pair of nipping members comprising a conveying roller configured to be rotated by the motor; and a controller configured to perform:

a motor controlling process of controlling the motor to perform a conveying operation of the sheet by rotation of the conveying roller;

a reaction-force calculating process of calculating a reaction-force inference value which corresponds to reaction force that acts on the motor, by removing a friction component generated due to rotation of the motor from a disturbance inference value, the disturbance inference value being calculated from both a control input to the motor and a control output relative to the control input; and a warning process of outputting warning in response to occurrence of multiple feeding of the sheet, based on the reaction-force inference value, wherein the controller is configured to further perform a reaching determining process of determining whether the sheet has reached the nipping position;

wherein, in the warning process, the controller is configured to calculate a standard value of the reaction-force inference value in a particular period after it is determined in the reaching determining process that the sheet has reached the nipping position, and to output the warning when the standard value is larger than or equal to a threshold value; and wherein, in the warning process, the controller is configured to calculate, as the standard value, a weighted average of the reaction-force inference value, the weighted average being obtained by using weight coefficients that decreases from a temporal center toward both ends of the particular period.

10. A sheet conveying apparatus comprising:

a motor;

a conveying mechanism having a pair of nipping members configured to nip a sheet from both sides thereof at a nipping position and to convey the sheet from an upstream side to a downstream side, the pair of nipping members comprising a conveying roller configured to be rotated by the motor;

an encoder arranged to detect rotation of the motor; and a controller configured to perform:

a reaching determining process of determining whether the sheet has reached the nipping position;

a motor controlling process of calculating a control input and of inputting the calculated control input to the motor, thereby controlling the motor to perform a conveying operation of the sheet by rotation of the conveying roller;

a measuring process of measuring a control output outputted by the motor, based on the rotation detected by the encoder;

a reaction-force calculating process including:

calculating output of an inverse model by inputting the control output measured by the measuring process to the inverse model, the inverse model being an inverse model of a characteristic model of the control output relative to the control input;

calculating a deviation between the output of the inverse model and the control input;

calculating a filter output by inputting the deviation to a filter configured to attenuate a high frequency component; and calculating a reaction-force inference value by removing a friction component from the filter output, the reaction-force inference value corresponding to reaction force that acts on the motor, the friction component being generated due to the rotation of the motor; and a warning process of outputting warning in response to occurrence of multiple feeding of the sheet, based on the reaction-force inference value, the warning process including:

calculating one of an amount of change and a rate of change of the reaction-force inference value in a particular period that starts when it is determined in the reaching determining process that the sheet has reached the nipping position, and outputting the warning when the one of the amount of change and the rate of change is larger than or equal to a threshold value, wherein the particular period is a time period defined based on a time constant of the filter, the particular period being a time period before the reaction-force inference value converges after the sheet reaches the nipping position.

11. The sheet conveying apparatus according to claim 10, wherein the particular period is defined between a third time point and a fourth time point, the third time point being a time point at which the reaction-force inference value starts increasing when the sheet reaches the nipping position, the fourth time point being a time point at which a time period corresponding to the time constant elapses after the third time point.

* * * * *